US009746244B2

(12) United States Patent
Mazzoni et al.

(10) Patent No.: US 9,746,244 B2
(45) Date of Patent: Aug. 29, 2017

(54) HEAT EXCHANGER FOR VEHICLE

(71) Applicant: VALEO SISTEMAS AUTOMOTIVOS LTDA, São Paulo (BR)

(72) Inventors: Armando Mazzoni, São Paulo (BR); Eder Nomoto, São Paulo (BR)

(73) Assignee: VALEO SISTEMAS AUTOMOTIVOS LTDA, Itatiba, São Paulo (BR)

( * ) Notice: Subject to any disclaimer, the term of this patent is extended or adjusted under 35 U.S.C. 154(b) by 76 days.

(21) Appl. No.: 14/897,574

(22) PCT Filed: Jun. 13, 2014

(86) PCT No.: PCT/BR2014/000194
§ 371 (c)(1),
(2) Date: Dec. 10, 2015

(87) PCT Pub. No.: WO2014/197960
PCT Pub. Date: Dec. 18, 2014

(65) Prior Publication Data

US 2016/0131430 A1 May 12, 2016

(30) Foreign Application Priority Data

Jun. 13, 2013 (BR) ..... 10 2013 0148 555

(51) Int. Cl.
*F28F 9/02* (2006.01)
*F28D 1/053* (2006.01)
(Continued)

(52) U.S. Cl.
CPC ..... *F28D 1/05325* (2013.01); *F28D 1/05375* (2013.01); *F28F 9/028* (2013.01);
(Continued)

(58) Field of Classification Search
CPC F28D 1/05325; F28D 1/05375; F28F 9/0264; F28F 9/0209; F28F 9/0263; F28F 9/028; F28F 9/0282
(Continued)

(56) References Cited

U.S. PATENT DOCUMENTS 4,072,183 A * 2/1978 Fraas ..... F22B 1/063 122/33
5,000,259 A 3/1991 Forrest
(Continued)

FOREIGN PATENT DOCUMENTS

JP H03 140764 A 6/1991
JP 2001 241806 A 9/2001
JP 2005 140374 A 6/2005

OTHER PUBLICATIONS

Written Opinion of the International Searching Authority mailed Sep. 4, 2014, issued in corresponding International Application No. PCT/BR2014/000194, filed Jun. 13, 2014, 4 pages.
(Continued)

*Primary Examiner* — Davis Hwu
(74) *Attorney, Agent, or Firm* — Christensen O'Connor Johnson; Matthew Balint; John Denkenberger

(57) ABSTRACT

A heat exchanger comprises a first header, a second header, a plurality of tubes, and a flow reducer. The first header is connected to a hot fluid inlet and to a cold fluid outlet, so that the first header comprises a hot region and a cold region, separated by a wall. Each of the plurality of tubes provides fluid communication between the first and second headers, including one tube located next to the wall in the hot region of the first header, being called "hot end tube", and one tube located next to the wall in the cold region of the first header, being called "cold end tube". The flow reducer reduces the
(Continued)

Figure 1:
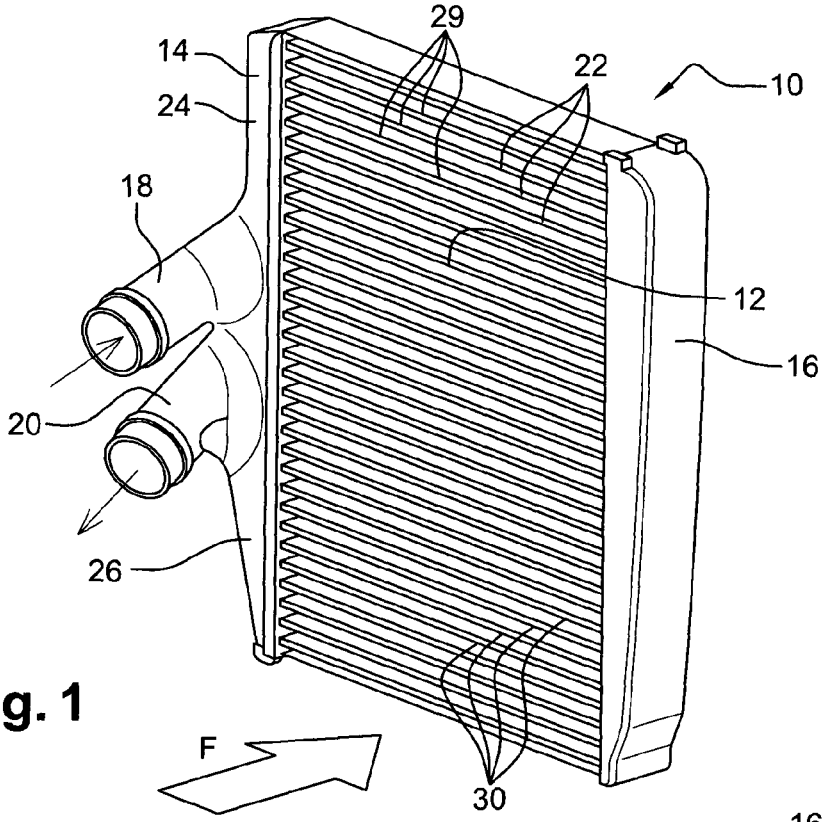

fluid flow in the hot end tube compared to the fluid flow in other tubes located in the hot region.

10 Claims, 3 Drawing Sheets

(51) Int. Cl.
*F02B 29/04* (2006.01)
*F28D 21/00* (2006.01)

(52) U.S. Cl.
CPC ..... *F28F 9/0209* (2013.01); *F28F 9/0263* (2013.01); *F28F 9/0265* (2013.01); *F28F 9/0282* (2013.01); *F02B 29/0456* (2013.01); *F28D 2021/0082* (2013.01)

(58) Field of Classification Search
USPC ..... 165/174
See application file for complete search history.

(56) References Cited

U.S. PATENT DOCUMENTS 5,186,249 A 2/1993 Bhatti
5,333,677 A * 8/1994 Molivadas ..... F03G 6/003 123/41.21
6,997,250 B2 * 2/2006 Dilley ..... F28F 9/0265 165/159

OTHER PUBLICATIONS

International Preliminary Report on Patentability mailed Dec. 15, 2015, issued in corresponding International Application No. PCT/BR2014/000194, filed Jun. 13, 2014, 1 page.
International Search Report, mailed Sep. 4, 2014, issued in corresponding International Application No. PCT/BR2014/000194, filed Jun. 13, 2014, 4 pages.

* cited by examiner

HEAT EXCHANGER FOR VEHICLE

The present invention relates to a heat exchanger for vehicles, and more specifically, but not exclusively, deals with heat exchangers such as charge air coolers (CAC).

Most heat exchangers comprise several rows of tubes which are arranged in the way of the charge air flow, while coolant (e.g. air) flows through the row of tubes. Usually, and in particular in charge air coolers, the heat exchanger comprises a first header including a hot air inlet as well as a cold air outlet, thus defining a hot air region and a cold air region. One part of the tubes is connected to the hot air region, whereas the other part is connected to the cold air region, both hot and cold regions being separated by a wall.

One difficulty caused by such an exchanger is that it includes one tube conducting hot air, called "hot end tube", located just next to another tube conducting cold air, called "cold end tube", because the hot air region is located next to the cold air region in the header. Therefore, the temperature difference between the hot end tube and the cold end tube leads to a high temperature gradient within a small area of the heat exchanger, which consequently can result in cracking of the tube at the vicinity of the header.

One aim of the present invention is to provide a heat exchanger which is more durable.

To this end, the object of the present invention is a heat exchanger for vehicle comprising:

a first header and a second header, the first header being connected to a hot fluid inlet and to a cold fluid outlet, so that the first header comprises a hot region and a cold region, separated by a wall, a plurality of tubes, each tube providing fluid communication between the first and second headers, including one tube located next to the wall in the hot region of the first header, being called "hot end tube", and one tube located next to the wall in the cold region of the first header, being called "cold end tube", wherein the heat exchanger comprises a flow reducer, for reducing the fluid flow in the end hot tube compared to the fluid flow in other tubes disposed in the hot region.

Such a heat exchanger is advantageous as the temperature gradient between the end cold tube and the end hot tube is lowered. Indeed, thanks to the flow reducer present in the hot end tube, less fluid is passing through the hot end tube and the fluid velocity is thus lowered. This results in the fluid being less hot than in the other tubes connected to the hot region, and so the gradient of temperature of the fluid in the cold end tube is reduced. Therefore, the thermal stresses that would normally be applied on these tubes are also lowered and the risk of failure of the tube is decreased, thus increasing the durability of the whole heat exchanger.

Preferably the fluid is air. Thus the hot fluid inlet and cold fluid outlet are respectively a hot air inlet and a cold air outlet, and the flow reducer reduces the air flow in the hot end tube.

It should be noted that the flow reducer includes any means able to reduce the fluid flow in the hot end tube. It may reduce the fluid flow in the hot end tube so that it is nil, i.e. there is no fluid at all passing through the tube.

The flow reducer can be located in the first header, in the second header, in the first and second header, or in the hot end tube.

A heat exchanger as defined above can also include one or more of the following features, taken alone or in combination.

The flow reducer comprises a wall that is located in the first header upstream relative to the hot end tube. This configuration enables in particular to reduce the cross-section of the first header upstream to the hot end tube, and thus the quantity of fluid entering the hot end tube, thus providing an efficient air flow reduction.

The wall comprises an aperture, the aperture having preferably a circular shape, such an aperture defining an area that is comprised from 1 to 2000 $mm^2$ (square millimeters), preferably from 1 to 1200 $mm^2$, and more preferably comprised from 20 to 320 $mm^2$.

The flow reducer includes a part positioned in the first header in front of the hot end tube. Such a specific positioning of the flow reducer allows the cross-section of the first header in front of the hot end tube to be reduced. Advantageously, the part has a width or diameter larger or equal to the width or diameter of the tube.

The hot end tube includes a fluid inlet and the flow reducer is positioned in the first header so that the distance between the flow reducer and this fluid inlet is ranging from 0 to 20 mm. This allows a size reduction of the cross-section of the first header.

The flow reducer comprises a wall located in the hot end tube, said wall partially or totally obstructing the tube. This way, the flow reducer can be manufactured together with the tube or assembled with the tube, independently from the configuration of the first or the second headers, while the headers can remain of a standard type.

The flow reducer is located in the second header, near a fluid outlet of the hot end tube. Such a positioning of the flow reducer in the second header provides an alternative way of reducing the air flow in the hot end tube. When a flow reducer is located in the second header in addition to a flow reducer placed in the first header, it permits further air flow reduction in the hot end tube.

The heat exchanger comprises a flow reducer for reducing the fluid flow in a hot tube located next to the hot end tube in the hot region. Reduction in the air flow in a hot tube located next to the hot end tube allows decreasing the temperature gradient even further.

The hot end tube comprises identifying means, allowing to distinguish the hot end tube from other tubes in the heat exchanger. The identifying means preferably comprises a mistake-proofing device that is configured to cooperate with a complementary mistake-proofing device provided on a core of the heat exchanger. Such identifying means ensure correct positioning of the hot end tube in the heat exchanger, avoiding any confusion with other tubes.

The heat exchanger is a charge air cooler. Usually, such a charge air cooler is used in the vehicle industry to cool down the compressed air of super charged or turbo charged engines. However, the heat exchanger could otherwise be applied on radiator, condenser, oil cooler and exhaust gas cooler.

Figure 2:
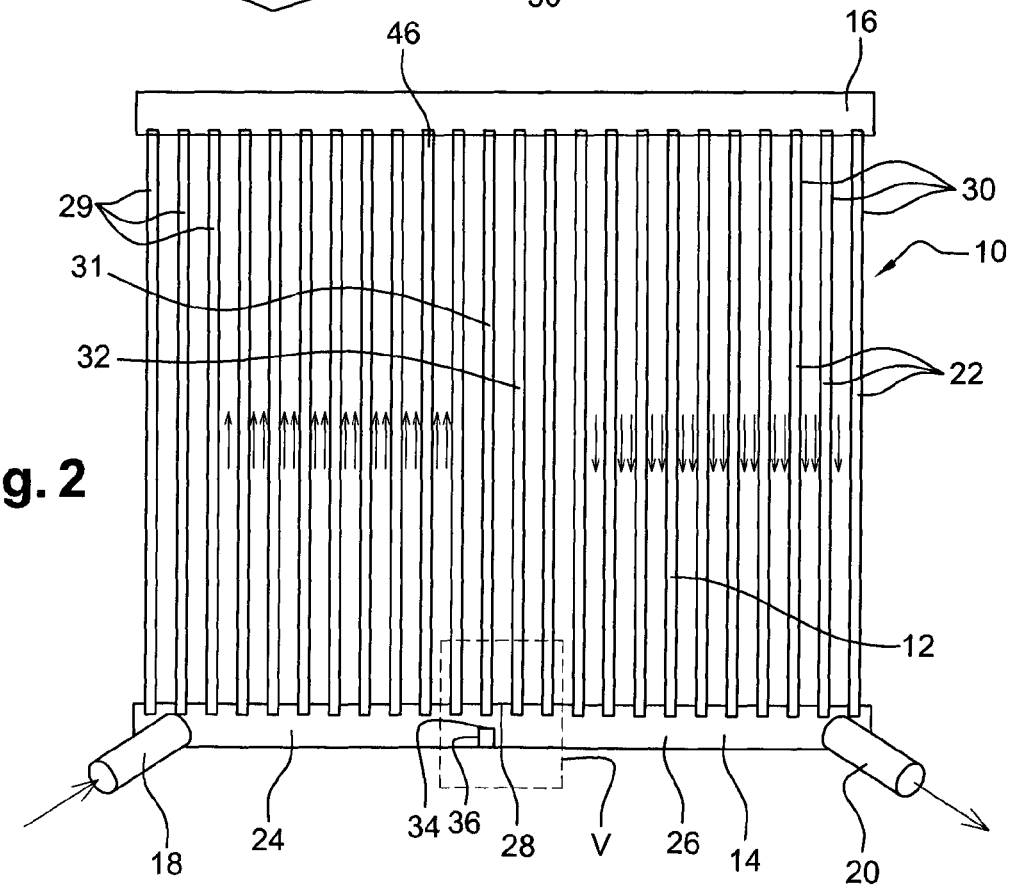
Figure 3:
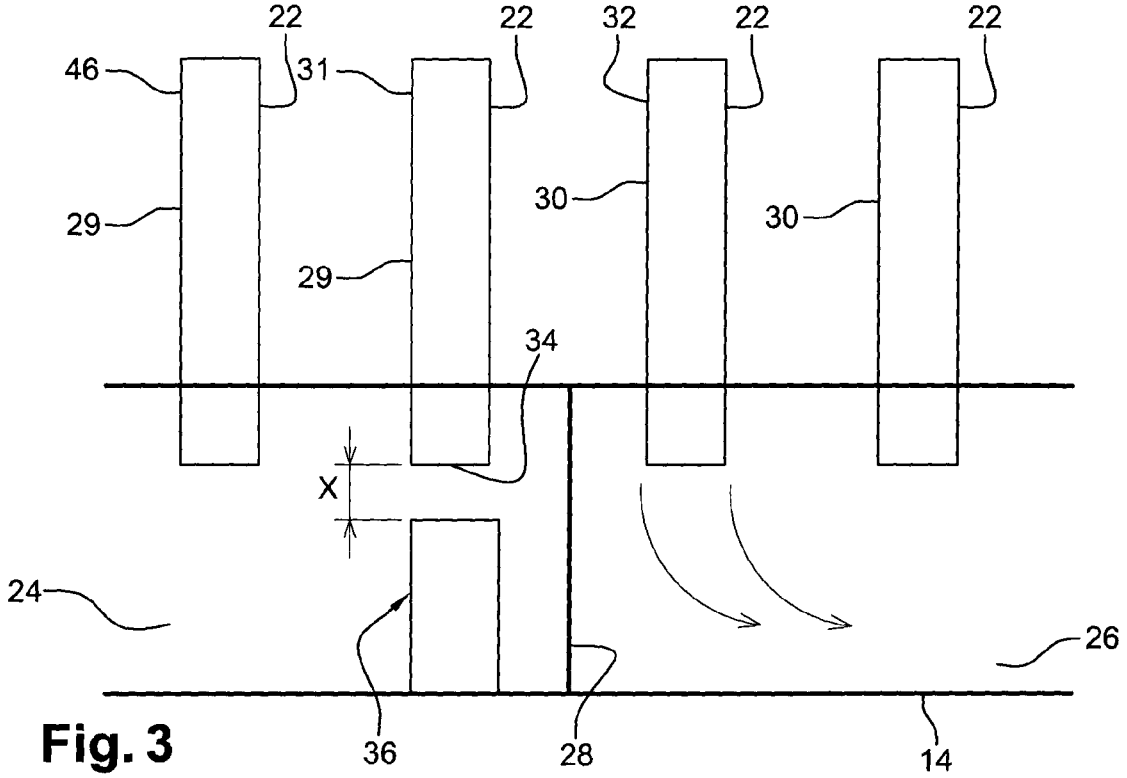
Figure 4:
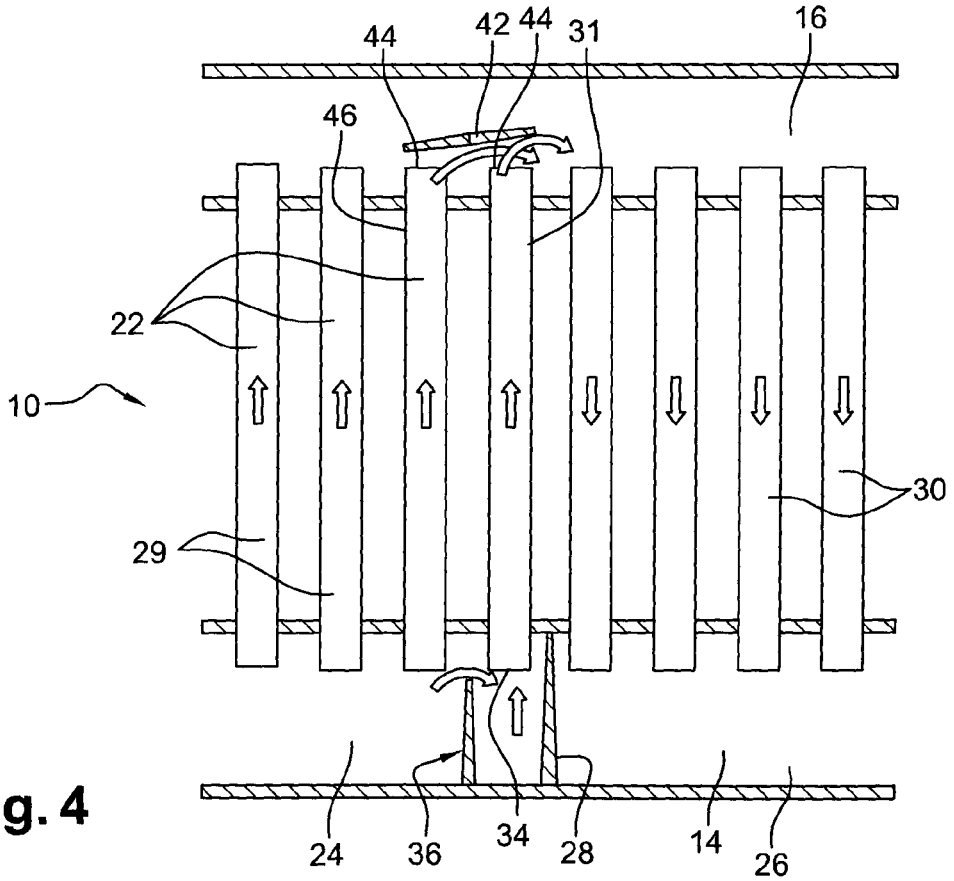
Figure 5:
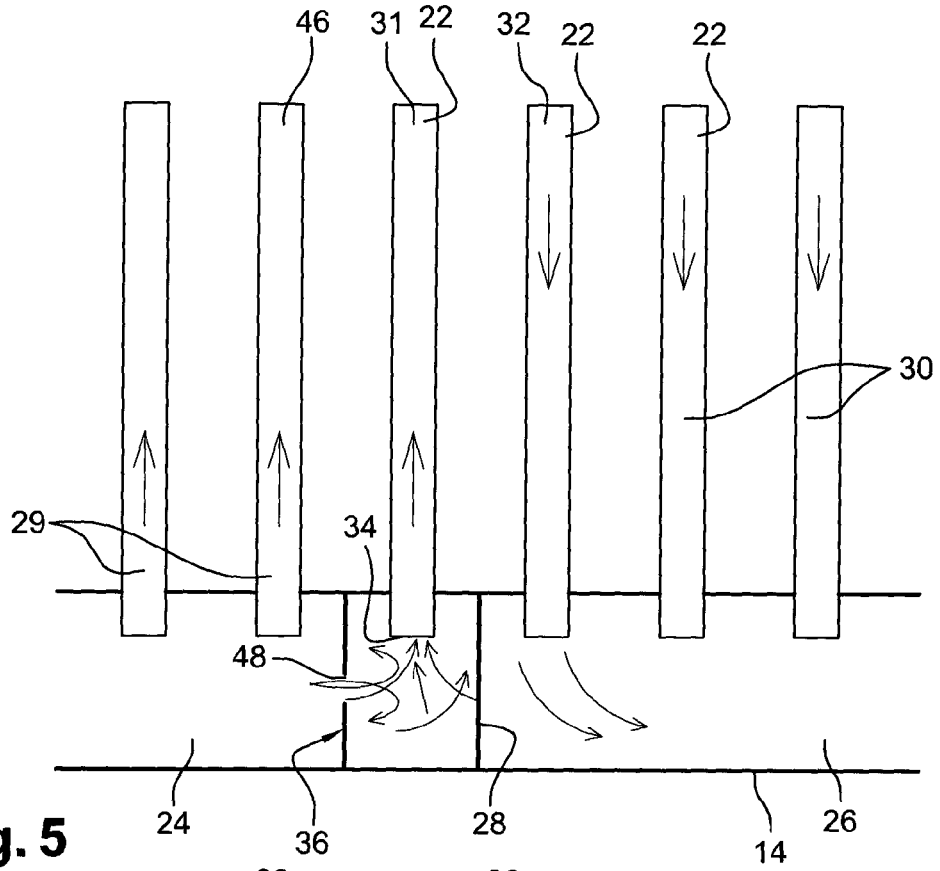
Figure 6:
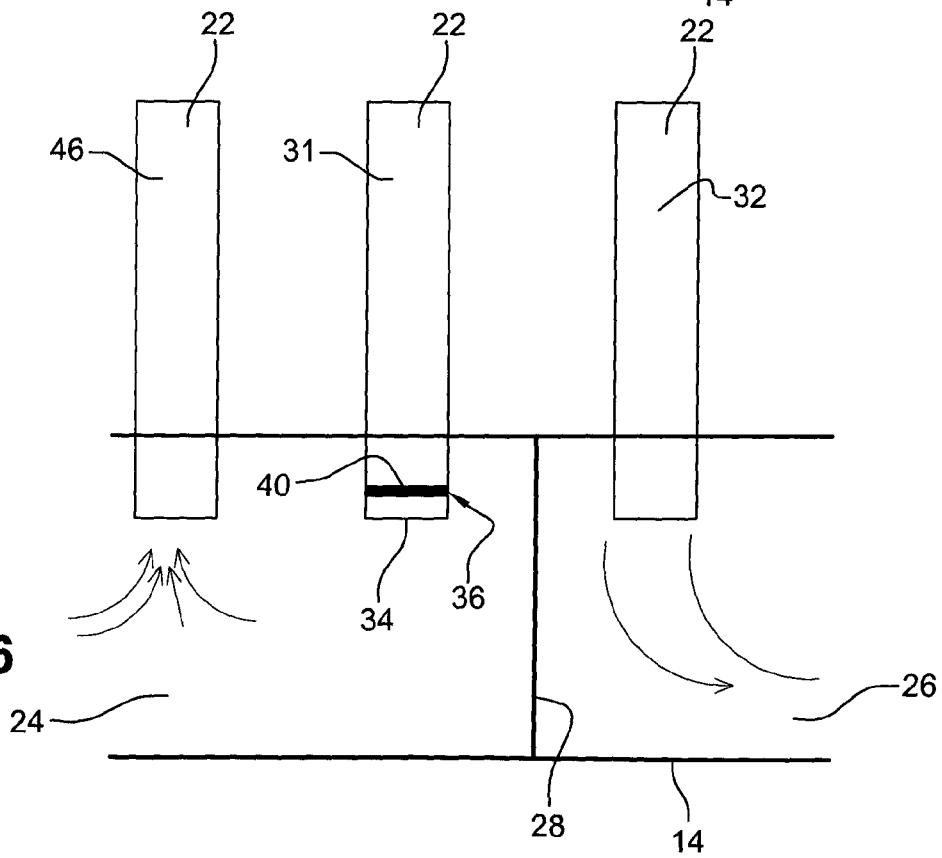

The present invention will become more fully understood from the following description, which is given by way of example only, and which is referring to the accompanying drawings, wherein:

FIG. 1 is a three-dimensional view of a heat exchanger according to a first embodiment of heat exchanger, FIG. 2 is a schematic longitudinal cross-section of a heat exchanger similar to the one of FIG. 1, FIG. 3 is an enlarged view of part V from FIG. 2, FIG. 4 is a partial schematic longitudinal cross-section of a heat exchanger according to a further embodiment of heat exchanger, FIG. 5 is a partial schematic longitudinal cross-section of a heat exchanger according to a third embodiment of heat exchanger, and FIG. 6 is a partial schematic longitudinal cross-section of a heat exchanger according to a fourth embodiment of heat exchanger.

A heat exchanger 10 for vehicle according to the first embodiment as shown on FIG. 1 is, in the present example, a charge air cooler intended to cool down the compressed air of super charged or turbo charged engines.

The heat exchanger 10 comprises a core 12, a first header 14 and a second header 16. The first header 14 is connected to a hot fluid inlet 18 and to a cold fluid outlet 20. In this example, the fluid is air and the heat exchanger 10 allows this air to circulate so that it can be cooled down by a coolant which can also be air in the example.

The core 12 of the heat exchanger 10 has essentially a parallelepiped shape extending in a longitudinal direction (which is vertical on FIG. 1), comprising two opposite longitudinal faces, with the first header 14 and the second header 16 being respectively connected to each of the longitudinal faces of the core 12. The core 12 comprises a plurality of tubes 22, each tube providing fluid communication between the first and second headers 14, 16. In the present case, the tubes 22 are flat; they have flat sides that extend parallel to the direction F of the coolant air flow. Alternatively, the tubes 22 could have other shapes, for example cylindrical shapes.

The first header 14 comprises a hot fluid region 24 and a cold fluid region 26, which are in fact a hot air region 24 and a cold air region 26. The hot region 24 receives hot air by means of the hot air inlet 18 and redirects this air towards the second header 16, and the cold region 26 receives air from the second header 16 and redirects it towards the cold air outlet 20.

FIG. 2 shows the hot region 24 and the cold region 26, that are separated by a wall 28. In this example, the wall 28 is located in a middle section of the first header 14. The plurality of tubes 22 comprises hot tubes 29, which are connected to the hot region 24, and cold tubes 30, which are connected to the cold region 26. The tubes are arranged in such a way that they exchange heat with the flow F of coolant passing through the core 12 of the heat exchanger 10. The hot tubes 29 are intended to take in hot air from the first header 14 and to conduct it towards the second header 16, while the cold tubes 30 are intended to take in cold air from the second header 16 and to conduct it towards the first header 14. Thus, the second header 16 is intended to receive air, which is hot air that has cooled down in the hot tubes 29, and to distribute it in the cold tubes 30. These cold tubes 30 are intended to conduct the cold air towards the first header 14 and to cool down the cold air further.

Among the hot tubes 29, one tube 31 is located next to the wall 28 in the hot region 24 of the first header 14. This tube is referred to as "hot end tube" 31 for ease of understanding. The hot end tube 31 comprises an air inlet 34 that is located in the first header 14 and through which the hot air flows. In the same way, one tube among the cold tubes 30 is located next to the wall 28 in the cold region 26 of the first header 14 and is referred as "cold end tube" 32.

In this embodiment, the first header 14 comprises a flow reducer 36 for reducing the fluid flow in the hot end tube 31 compared to the fluid flow of the other hot tubes 29. The flow reducer 36 is located in the hot region 24 of the first header 14, upstream relative to the hot end tube 31. More precisely, it is located in front of the inlet 34 of the hot end tube 31. As shown on FIG. 3, the flow reducer 36 of the present embodiment comprises a part 36, having a cross-section shape which is similar to the cross-section shape of the hot end tube 31. In this embodiment, part 36 is quite rectangular, with a width which is preferably similar to the width of the tube 31. However, the part 36 of the flow reducer 36 may be of a different shape than rectangular as long as it allows reduction of the air flow of the first hot end tube 31 as compared to the air flow of the other hot tubes 29. The hot end tube 31 is positioned in the first header 14 so that the distance between the flow reducer 36 and the air inlet 34 of the end hot tube 31 ranges from 0 to 20 mm, for example is about 10 mm long.

Other configurations of flow reducer 36 can be used, as shown in particular on FIGS. 4 to 6. The references used to designate similar features of the first embodiment are being re-used in respect of these other embodiments.

According to FIG. 4, the flow reducer 36 comprises a wall located in the hot region 24 of the first header 14 between the hot end tube 31 and the tube 46 next to the hot end tube 31. Tube 46 is also referred to as second hot tube 46. In this specific embodiment, the wall of the flow reducer 36 has the appearance of a thin baffle which partially closes the cross section of the first header 14, leaving a gap for the air to reach the air inlet 34 of the hot end tube 31.

On this particular embodiment, the heat exchanger 10 comprises an additional flow reducer 42 that is located in the second header 16, near air outlets 44 of the hot end tube 31 and of the hot tube 46 next to it. It thus allows for reduction of the air flow in the hot tube 46 next to the hot end tube 31 wherein the airflow is also further reduced.

In accordance with FIG. 5, the wall of the flow reducer 36 is located in the hot region 24 of the first header 14, between the hot end tube 31 and the second hot tube 46. It comprises an aperture 48 that is circular in shape and that defines an area ranging from 1 to 2000 $mm^2$, preferably from 1 to 1200 $mm^2$ or more preferably from 20 to 320 $mm^2$, for example is about 20 $mm^2$.

As shown on FIG. 6, the flow reducer 36 comprises a wall 40 located in a lower part of the hot end 31 tube and totally obstructing it, the air flow being thus reduced to zero. However, it would be possible to envisage that the wall 40 may be only partially obstructing the hot end tube 31, in order to allow a reduced air flow. In the case where the wall 40 is totally obstructing the hot end tube, it is preferred to close off both ends of the tubes, this configuration implying that the flow reducer comprises a second wall located at the top of the end hot tube. In order to facilitate manufacturing of a heat exchanger 10 comprising a hot end tube 31 equipped with such a closed-off tube, the heat exchanger 10 comprises identifying means that are provided to differentiate the hot end tube 31 from other tubes in the heat exchanger 10. The identifying means preferably comprises a mistake-proofing device that is configured to cooperate with a complementary mistake-proofing device provided on the core 12 of the heat exchanger. Such a device may be for example a specific hot end tube 31 having a smaller diameter than the rest of the tubes 22, the first header having a slot of a corresponding diameter for receiving said specific first hot tube 31.

The various embodiments described above may vary in many ways. For instance, the flow reducer 36 placed in the first header 14 may extend in front of the second hot tube 46, thus resulting in flow reduction in the second hot tube as well as in the hot end tube. Alternatively, the flow reducer 36 may comprise several parts located in the first header 14, in the hot end tube 31 and/or in the second hot tube 46.

The invention claimed is:

1. A heat exchanger for vehicle comprising:

a first header and a second header, the first header being connected to a hot fluid inlet and to a cold fluid outlet, so that the first header comprises a hot region and a cold region, separated by a wall, a plurality of tubes, each tube providing fluid communication between the first and second headers, including a hot end tube located next to the wall in the hot region of the first header and a cold end tube located next to the wall in the cold region of the first header, wherein the heat exchanger comprises a flow reducer for reducing the fluid flow in the hot end tube compared to the fluid flow in other tubes located in the hot region.

2. A heat exchanger according to the claim 1, wherein the flow reducer comprises a wall that is located in the first header upstream relative to the hot end tube.

3. A heat exchanger according to claim 1, wherein the wall comprises an aperture, the aperture having preferably a circular shape, such an aperture defining an area having a range selected from a group of ranges consisting of from 1 to 2000 $mm^2$, from 1 to 1200 $mm^2$, and from 20 to 320 $mm^2$.

4. A heat exchanger according to claim 1, wherein the flow reducer includes a part positioned in the first header in front of the hot end tube.

5. A heat exchanger according to claim 1, wherein the hot end tube includes a fluid inlet and wherein the flow reducer is positioned in the first header so that the distance between the flow reducer and this fluid inlet ranges from 0 to 20 mm.

6. A heat exchanger according to claim 1, wherein the flow reducer comprises a wall located in the hot end tube and obstructing it, partially or totally.

7. A heat exchanger according to claim 1, wherein the flow reducer is located in the second header, near a fluid outlet of the hot end tube.

8. A heat exchanger according to claim 1, also comprising a flow reducer for reducing the fluid flow in a hot tube located next to the hot end tube in the hot region.

9. A heat exchanger according to claim 1, wherein the hot end tube comprises identifying means, allowing to distinguish the hot end tube from other tubes in the heat exchanger, the identifying means preferably comprising a mistake-proofing device that is configured to cooperate with a complementary mistake-proofing device provided on a core of the heat exchanger.

10. A heat exchanger according to claim 1, the heat exchanger being a charge air cooler.

* * * * *